US006808104B2

(12) United States Patent
Cobble

(10) Patent No.: US 6,808,104 B2
(45) Date of Patent: Oct. 26, 2004

(54) SUBFOLDER INSERT FOR FILE FOLDERS

(76) Inventor: Daniel L. Cobble, 3401 Lesway Ct., Ste. 12, Louisville, KY (US) 40220

( * ) Notice: Subject to any disclaimer, the term of this patent is extended or adjusted under 35 U.S.C. 154(b) by 0 days.

(21) Appl. No.: 09/829,756

(22) Filed: Apr. 10, 2001

(65) Prior Publication Data

US 2002/0147093 A1 Oct. 10, 2002

(51) Int. Cl.[7] ..... B65D 27/00

(52) U.S. Cl. ..... 229/67.1; 281/29; 281/45; 40/341; 40/359

(58) Field of Search ..... 283/116, 36; D19/33; 281/29, 45; 229/72, 67.1, 67.3; 402/79, 60; 40/359, 341; 206/425; 493/947

(56) References Cited

U.S. PATENT DOCUMENTS

| | | | | | |
|---|---|---|---|---|---|
| 2,052,623 | A | * | 9/1936 | Harby | 40/341 |
| 3,528,602 | A | * | 9/1970 | Ritchie | 229/67.1 |
| 3,870,223 | A | * | 3/1975 | Wyant | 206/215 |
| 4,602,734 | A | * | 7/1986 | Thompson | 283/116 |
| 4,962,951 | A | * | 10/1990 | Mechesney | 283/114 |
| 5,056,825 | A | * | 10/1991 | Templet | 281/20 |
| 5,174,606 | A | * | 12/1992 | Hure | 281/45 |
| 5,882,038 | A | * | 3/1999 | Ong | 402/79 |
| 6,332,570 | B2 | * | 12/2001 | Frei | 229/67.1 |
| 6,453,589 | B1 | * | 9/2002 | Schwartz | 40/359 |

* cited by examiner

*Primary Examiner*—Stephen F. Gerrity
*Assistant Examiner*—Thanh Truong
(74) *Attorney, Agent, or Firm*—Stites & Harbison, PLLC

(57) ABSTRACT

A subfolder insert, or otherwise short-termed a "subfolder" for depicting its sub-file contents, for holding related papers of its conventional file folder, and as such, the subfolder is inserted within the file folder, for separation of designated papers from other papers within the file folder. To avoid the subfolder causing the file folder from being bulky and obscuring the "sub-held" papers, its surface area is effectively less than the surface area of the sub-held papers of a respectively standard size, such as a U.S. letter size and legal size; this, too, allows visual, physical exposure of the sub-held papers for easy reference and manual retrieval from within the subfolder. The front and back panels of the subfolder are integrated along multiple adjacent edges, as ideally a vertical edge and the bottom horizontal edge.—This multi-plane integration allows 1) effective securing and isolation of papers while the subfolder is inside the file folder, 2) easy, lateral insertion and retrieval of designated papers from the subfolder, and 3) easy shuffling and straightening of papers while inside the subfolder. Another feature for easier handling is a pull-tab that flanges independently and is perpendicular to the vertically integrated edge, for holding with one hand while laterally pulling papers from the subfolder with the other hand. This pull-tab may be formed and die-cut from the subfolder's surface area, during manufacture. Also, the subfolder has a through-pass opening that intervenes the integration between the front and back panels. This opening allows the respective corners of voluminous papers to be easily shuffled and aligned along the planes of said integration which would otherwise tend to "bunch up" with resistance upon this area of the subfolder being enclosed.

9 Claims, 5 Drawing Sheets

SUBFOLDER INSERT FOR FILE FOLDERS

FIELD OF THE INVENTION

The present invention relates to the categories of office supplies and accessories, and most specifically to those accessories involving the filing, storage and retrieval of hard copy records and data.

BACKGROUND OF THE INVENTION

The present invention comprises a sub-file (subordinate file) insert for hard copy, paper files. Upon an appropriate design, sub-files kept in file folders would be of tremendous use to almost everyone: the bulky files of paralegals, the complex files of doctors, the voluminous files of government officials, etc., of only a few examples.

Although the function of the present invention apparently is not addressed by the prior art, there have ensued other prior art that relate in general design likenesses to the present invention. For instance, Assignor Hure's End Flap File Folder and Method of Use, U.S. Pat. No. 5,174,606, comprises a traditional type folder and having an end flap on the bottom for preventing the spilling of papers during its handling. However, Hure's design does not collect and bind papers with the elemental features of the present invention, notwithstanding the differences in specified function.

Another utility design is Mitsuyama's Document File, U.S. Pat. No. 4,764,159, that provides a manufacturing method for assembling multiple divisions of file compartments into a single encasement. Although Mitsuyama's structure may serve a similar purpose as the present invention for use as sub-files, such divisions are stationary, and therefore lack the modular, portable and compact advantages of the present invention.

The practice of "placing" sub-files within primary file folders is not new. To wit, all computer systems use this filing model as a "virtual" application for allowing users to conveniently organize their computer files for saving search and retrieval time. And, of course, this feature is most helpful when computer files have accumulated to when their management becomes cumbersome. Creating sub-files establish sub-categories so that the user need not bother with those documents that are not relevant to current use.

To wit, the present invention, called a Subfolder Insert for File Folders, mimics the computer model for hard copy filing but must address specific handling concerns. For example, a "subfolder" of papers must be easy to handle for quick manipulation in high activity environments. Thereto, it should not obscure papers of the sub-file/s while within the file folder, lest the taking of excess time when searching for papers. Also, papers should be essentially secured within an isolated sub-file "packet" so as not to be loosely manipulated or easily disturbed during handling of the file folder. Yet, the sub-held papers must insert and retrieve easily from such subfolder.

Hence, an appropriate design may well impact the typical work-place in providing a simple, effective "helping hand," where required. Therefore, what is needed is a subfolder insert that possess the above characteristics, to improve filing organization for increased production and to further streamline document accounting methods.

SUMMARY OF THE INVENTION

The present invention, being the subfolder insert for file folders, or otherwise short-termed: subfolder, for depicting its sub-file (subordinate file) contents, is for being inserted and contained within its file folder. Therefore, it comprises several important design elements.

To begin with, the subfolder has a front panel and a back panel, to contain papers between these two panels, and both panels integrate along multiple edges, ideally a vertical edge and along the horizontal bottomside. Such "multi-plane" edge binding of the front and back panels provide effective securing of held papers as an isolated packet that cannot be easily dislodged, unless by intended effort. Hence, the subfolder must have a least one edge that opens between the front and back panels for receiving papers. Ergo, illustrations of the present invention show the front and back panels integrated along two adjacent edges and leaving open the top edge and other vertical edge for convenient lateral inserting and removing of papers into and from the subfolder, respectively. Preferably, the right vertical side is the open side, for accommodating lateral movement of the right hand, as most people are right-handed. This configuration may be termed the: primary configuration.

Accordingly, these asymmetrically-placed features may be re-arranged and even reversed into various configurations, as the utility of the subfolder would be the same. For example, upon the front and back panels being integrated along both vertical edges and the bottomside edge, then only the topside would be open for receiving papers, and therefore, the relative securing of the papers between the two panels of the subfolder would still result.

However, as explained, the stated primary configuration readily accommodates lateral movement of the right-hand for inserting and retrieving papers from the subfolder. This is an important benefit for the user, due to the ergonomic-related motions of manipulating papers, especially in high activity environments.

During manufacture, the subfolder may begin as a single sheet and then be die-cut and machine-folded along the left vertical edge, and glued along the bottom edge as a second integration of the front and back panels.

Another functioning element of the subfolder is that its surface area of the front and/or back panel is smaller than the surface area of a paper sheet that it may hold. For example, a subfolder designated to hold standard 8½ in.×11 in. letter size papers may have a surface area of 7¾ in.×9 in. With said primary configuration, papers are held within the subfolder nearly flush along a vertical and bottom horizontal edges where the front and back panels are integrated, and thus this smaller surface area allow papers to be physically exposed along the horizontal top (approx. 2 in.) and the vertical right side (approx. ¾ in.) while within the subfolder. This dual-edge physical exposure, for easy reference and manual manipulation of the papers, is especially helpful when the subfolder is inserted in the file folder; the user may manually shuffle and page-through the file folder and still view the front and rear papers of the subfolder(s) for ready recognition. And of course, when the subfolder is outside the file folder the exposed papers are readily identifiable.

Also, this lesser area of the subfolder's paper size/mass avoids bulky files, especially when the file folder contains several subfolders. Thereto, for other standard paper sizes, such as legal (8-½ in.×14 in.) and A-4 sizes, the surface area of a subfolder may be sized such as above, to accommodate these and any other respectively standard paper size.

Bulky files can also be avoided by using light-weight to mid-weight paper that range from 24–32 lb. weights. These less durable papers are suitable as a subfolder, because the subfolder is ideally kept inside the file folder (unless it is being temporarily used or transported), as contrasted by the heavier paper/material of conventionally durable file folders that are used for comprehensive file storage.

To further increase functionality, the subfolder has a through-pass opening that intervenes the integration between the front and back panels. This opening is separate from the main opening for entry and retrieval of papers; it allows the respective corners of voluminous papers to easily be shuffled while within the subfolder and align along the vertical and horizontal integrated planes of the front and back panels, which would otherwise tend to "bunch up" with resistance within an enclosed area of the subfolder.

Therefore, a subfolder is not practical for functioning as a conventional file folder, because the exposed area of papers is subjected to undue environmental exposure, being without the complete cover protection of a conventional file folder; and, as aforementioned, a subfolder's ideal lighter-weight paper does not provide the durability of conventional file folder materials.

Also, there are two other practical features of the subfolder. A pull-tab integrates and flanges, ideally, from a vertical edge of the subfolder. The pull-tab is held by the thumb and index finger of one hand while the other hand grasps the collectively exposed edges of inserted papers to laterally pull them away for removal from the subfolder. The pull-tab may be formed and die-cut from the subfolder during manufacture. Ideally, too, the pull-tab should be on the vertical left, integrated edge, so that the papers may be pulled away laterally by the right hand.

The other feature is the identification template that may be printed or embossed on the subfolder. This template provides for identifying the subfolder's sub-file content, and it may also identify the name of the file folder that contains the subfolder.

LIST OF ILLUSTRATIONS

NOTE: Herein the description of the preferred embodiments the subfolder will be termed "subfolder insert" in accordance with its formal title.

DESCRIPTION OF THE PREFERRED EMBODIMENTS

Figure 1:
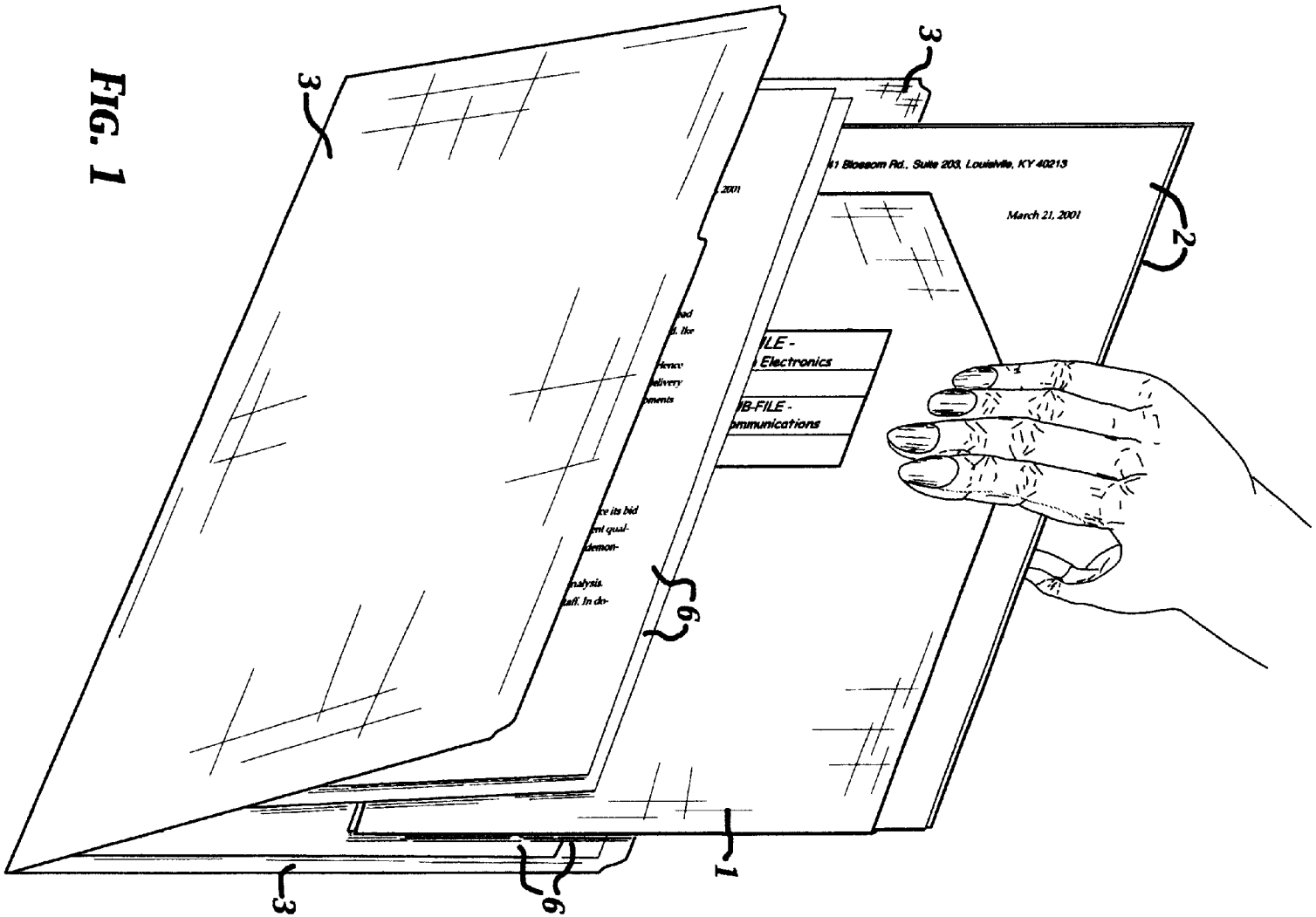
FIG. 1 shows the subfolder insert containing papers and being inserted into a file folder of other papers.

FIG. 1 shows a view of the Subfolder Insert 1 for File Folders being inserted into file folder 3. Consequently, the subfolder insert contains sub-held papers 2 as a sub-file for said file folder. Multiple papers 6 are other papers within the file folder being held with the sub-file.

Figure 2:
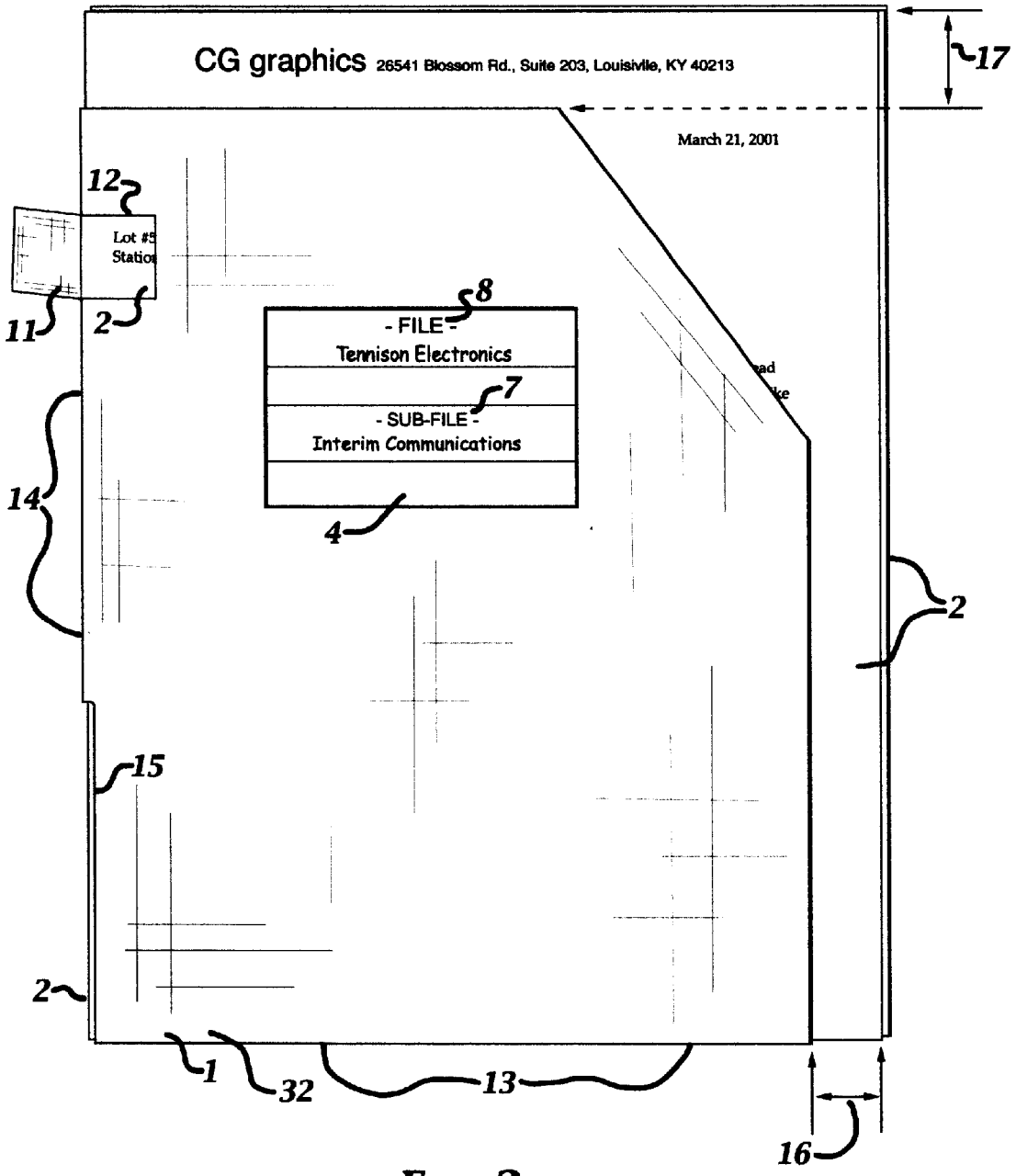
FIG. 2 is a front view of the subfolder insert containing papers.

FIG. 2 is a front view of subfolder insert 1 still containing sub-held held papers 2. Vertical edge 14 and horizontal edge 13 exemplify multiple adjacent edges where front panel 32 and the back panel (not shown in FIG. 2) of the subfolder insert integrate for essentially comprising the subfolder insert. Through-pass opening 15 allows exposure of the lower left corners of said sub-held papers 2. Dimension line arrows 16 depict width of the exposed surface area of sub-held papers 2 along the vertical plane, and dimension line arrows 17 depict width of the exposed surface area of the sub-held papers 2 along the horizontal plane. This exposed area about the perimeter of the subfolder insert's panels show that the surface area of a panel, thereof, is less than the surface area of the designated papers to be held. Pull-tab 11 is integrated with said vertical edge but flanges independently for grabbing with the index finger and thumb. Die-cut perimeter 12 is the patterned cut-out of which the pull-tab is cut from the subfolder, typically by a machine. The exposed area within said perimeter 12 exposes the front page of sub-held papers 2 when the pull-tab is pulled away from said perimeter. Label template 4 shows a printed or embossed markings for at least labeling the subfolder insert for its related sub-file contents, such as a sub-file name under "SUB-FILE" 7, and the name of the file folder under "FILE" 8 that would be containing the subfolder insert.

Figure 3:
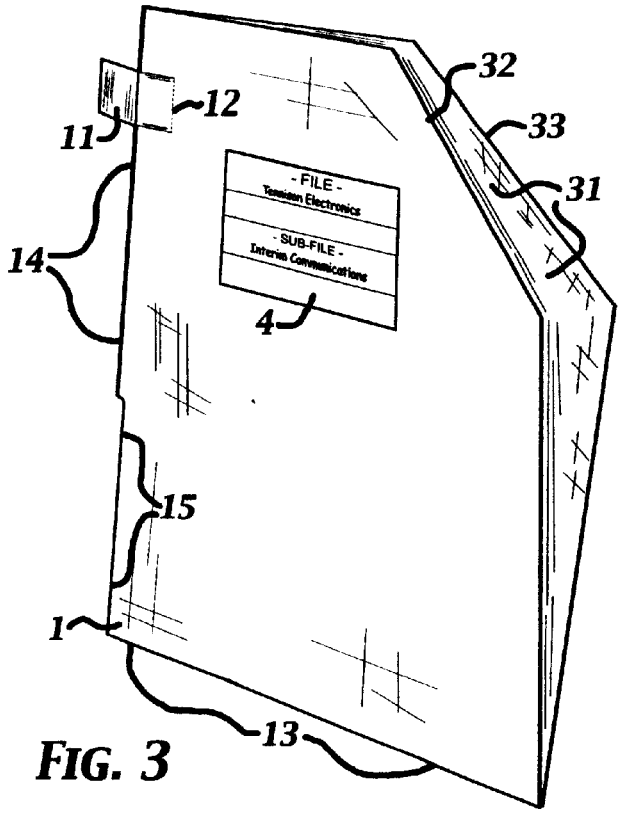
FIG. 3 is a front composite view of the subfolder insert without papers.

FIG. 3 is a front composite view of the subfolder insert 1 without papers. Front panel 32 is integrated with back panel 33 along said vertical edge 14 and said horizontal edge 13. Open area 31 is the open entry space between said front panel and said back panel for receiving papers. All other elements shown are described above.

Figure 4:
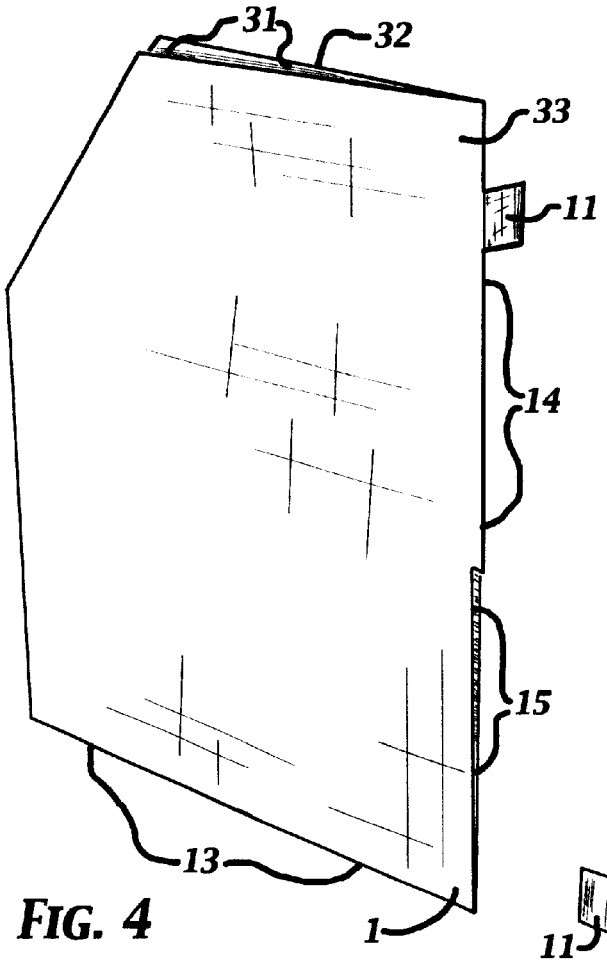
FIG. 4 is a backside composite view of the subfolder insert without papers.

FIG. 4 is a backside composite view of the subfolder insert 1 without papers that show the elements as described above including back panel 33. The respective composite view of through-pass opening 15 provide for the respective corners of said sub-held papers to pass through said through-pass opening for physical exposure when placed into the subfolder insert (also, review FIG. 2 and see FIG. 5).

Figure 5:
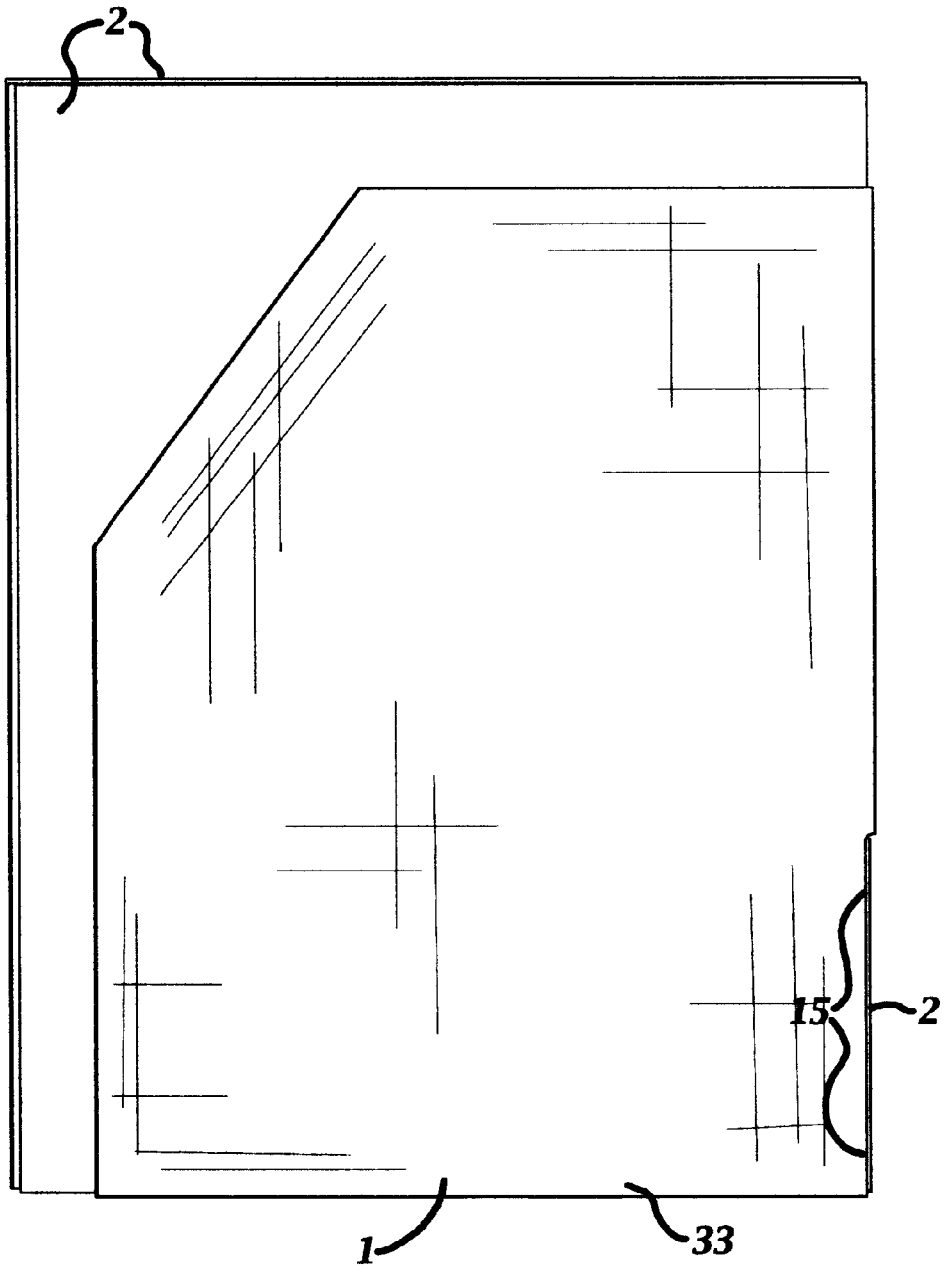
FIG. 5 shows the backside view of the subfolder insert containing papers with the pull-tab and front side being obscured.

FIG. 5 is a backside view of the subfolder insert 1 showing back panel 33 with sub-held papers 2 within the subfolder, and said sub-held papers protruding through said through-pass opening 15.

Figure 6:
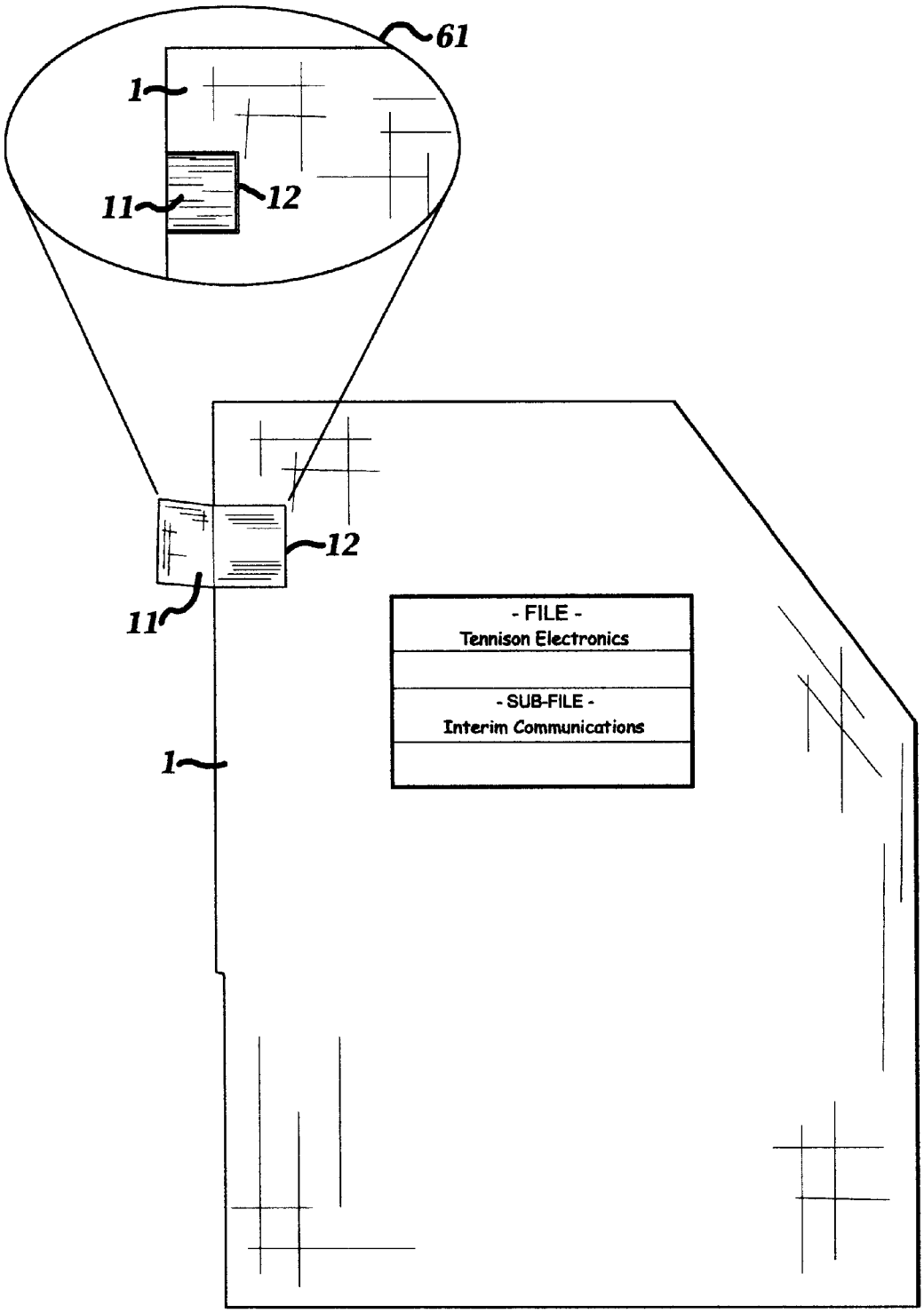
FIG. 6 shows the front panel with the pull-tab flanged outward and integrated with the subfolder insert's vertical edge and a contrasting macro view of the pull-tab folded in toward the subfolder insert within the die-cut perimeter.

FIG. 6 is a front view of the subfolder insert 1 and macro view 61 of pull-tab 11 folded over and within said die-cut perimeter 12, to contrast the otherwise flanged position of pull-tab 11 that is outside the macro view.

What I claim is:

1. A subfolder that is made from paper material, for being held within its primary file folder; said subfolder having substantive surface area to encapsulate the substantial surface area of documents that make up a subfile being held within said folder; and whereupon papers are fully inserted in said subfolder, said subfolder comprises a front side and a back side that are facially affixed; and said front side and said back side being facially affixed by mutual integration along a vertical side and the bottom side of said subfolder to form respective common edges, thereof, at said vertical side and said bottom side; and said subfolder having the topside and other vertical side receivably open for receiving documents;

a) and said subfolder having a through-pass opening that intervenes the facial affixment of said front side and said back side along respective portions of said bottom side and said vertical side, b) and, the encapsulative function of said subfolder provides as a self contained packet of documents for transport and handling when outside of said folder, c) and the surface area of said subfolder being smaller than the surface area of its held documents so that the documents are exposed for view when held within said subfolder.

2. The subfolder of claim 1 including further: said subfolder is provided with indicia for entering information.

3. The subfolder of claim 1 including further: a pull-tab being integrated with said subfolder, for grasping said pull-tab when retrieving documents from said subfolder.

4. A subfolder that is made from paper material, for being held within its primary file folder; said subfolder having substantive surface area to encapsulate the substantial surface area of documents that makes up a subfile being held within said folder; and whereupon papers are fully inserted in said subfolder, said subfolder comprises a front side and a back side that are facially affixed; and said front side and said back side being facially affixed by mutual integration along a vertical side and the bottom side of said subfolder to form respective common edges, thereof, at said vertical side and said bottom side; and said subfolder having the topside and other vertical side receivably open for receiving documents;

a) said subfolder is provided with indicia for entering information, b) and, the encapsulative function of said subfolder provides as a self contained packet of documents for transport and handling when outside of said folder, c) and the surface area of said subfolder being smaller than the surface area of its held documents so that the documents are exposed for view when held within said subfolder.

5. The subfolder of claim 4 including further: said subfolder having a through-pass opening that intervenes the facial affixment of said front side and said back side.

6. The subfolder of claim 4 including further: a pull-tab being integrated with said subfolder, for grasping when retrieving documents from said subfolder.

7. A subfolder that is made from paper material, for being held within its primary file folder; said subfolder having substantive surface area to encapsulate the substantial surface area of documents that makes up a subfile being held within said folder; and whereupon papers are fully inserted in said subfolder, said subfolder comprises a front side and a back side that are facially affixed; and said front side and said back side being facially affixed by mutual integration along a vertical side and the bottom side of said subfolder to form respective common edges, thereof, at said vertical side and said bottom side; and said subfolder having the topside and other vertical side receivably open for receiving documents;

a) and a pull-tab being integrated with said subfolder, for grasping said pull-tab when retrieving documents from said subfolder, b) and, the encapsulative function of said subfolder provides as a self contained packet of documents for transport and handling when outside of said folder, c) and the surface area of said subfolder being smaller than the surface area of its held documents so that the documents are exposed for view when held within said subfolder.

8. The subfolder of claim 7 including further: said subfolder having a through-pass opening that intervenes the facial affixment of said front side and said back side.

9. The subfolder of claim 7 including further: said subfolder is provided with indicia for entering information.

* * * * *